US005103200A

United States Patent [19]

Leupold

[11] Patent Number: 5,103,200

[45] Date of Patent: Apr. 7, 1992

[54] HIGH-FIELD, PERMANENT MAGNET FLUX SOURCE

[75] Inventor: Herbert A. Leupold, Eatontown, N.J.

[73] Assignee: The United States of America as represented by the Secretary of the Army, Washington, D.C.

[21] Appl. No.: 709,548

[22] Filed: Jun. 3, 1991

[51] Int. Cl.[5] ..... H01F 1/00; H01F 7/00; H01F 7/02

[52] U.S. Cl. ..... 335/217; 335/306

[58] Field of Search ..... 335/217, 301, 302, 304, 335/306

*Primary Examiner*—Leo P. Picard
*Assistant Examiner*—Ramon M. Barrera
*Attorney, Agent, or Firm*—Michael Zelenka; William H. Anderson

[57] ABSTRACT

A first shell of magnetic material having a hollow cavity is magnetized and has a remanence to produce a first uniform field in the cavity. The first shell has a temperature coefficient such that the first uniform field varies with temperature in a first direction. A second shell, mounted concentrically with the first shell, has a remanence substantially the same as the remanence of the first shell and is magnetized to produce a second uniform field in the cavity in the same direction as the first uniform field. The second shell has a temperature coefficient that is opposite to and much larger than the temperature coefficient of the first shell. Changes in temperature will cause the cavity fields produced by each of the two shells to vary in opposite directions such that there will be virtually no net change in the combined cavity field.

7 Claims, 4 Drawing Sheets

HIGH-FIELD, PERMANENT MAGNET FLUX SOURCE

GOVERNMENT INTEREST

The invention described herein may be manufactured, used, and licensed by or for the Government for governmental purposes without the payment tome of any royalty thereon.

BACKGROUND OF THE INVENTION

1. Field of the Invention

The present invention relates to high-field permanent magnet flux sources. More specifically, it relates to a temperature compensating means for use with permanent-magnet flux sources such as magic spheres and the like.

2. Description of the Prior Art

Magic spheres, toroids, igloos, rings and similar compact magnetic structures have been developed for use as high magnetic field sources that do not need an electric power supply. Such unusual magnetic structures were made possible by the advent of rare-earth permanent magnets which have significantly high remanences and coercivities.

U.S. Pat. No. 4,837,542 describes a typical magic sphere. U.S. Pat. No. 4,839,059 discloses a magic ring for use in a wiggler or a twister. Further details of these and similar permanent magnets are disclosed in the papers entitled *A Catalogue of Novel Permanent Magnet Field Sources* by H. A. Leupold, et al., Paper No. W3.2 at the 9th International Workshop on Rare-Earth Magnets and Their Applications, Bad Soden, FRG, 1987; and IEEE Transactions on Magnetics, Vol. MAG-23, No. 5, Sept. 1987, pp. 3628–3629.

Although such high-field magnets have served the purpose, they have not proved entirely satisfactory under all conditions of service for the reason that considerable difficulty has been experienced in maintaining a constant working magnetic field under temperature changes in temperature-sensitive magnets. More specifically, it has been known for some time that magic spheres can produce very large working fields in a relatively large cavity with relatively small structural bulk. For example, a magic sphere four inches in diameter can produce a working magnetic field of 20–30 kilogauss (kG) in a cavity that is one inch in diameter.

It has been known that rare earth permanent magnets of the type discussed above can produce very high fields that may be in excess of the remanence of the magnetic material used. For some applications, it is very important that the working fields remain constant to a very high degree of precision, e.g. within a few parts per million. In some instances chemically temperature-compensated magnets have been used for this purpose. However, this solution is not entirely satisfactory because chemical compensation often entails considerable loss in magnetic remanence with a proportional decrease in field strength. To prevent the latter, more material is used to compensate for the remanence loss, thereby creating greater bulk.

Consequently, there has been a need for improvements in the design of magic spheres, toroids, igloos, rings and like permanent magnet flux sources to render such devices less sensitive to temperature changes.

SUMMARY OF THE INVENTION

The general purpose of this invention is to provide a high-field permanent-magnet flux source which embraces all the advantages of similarly employed devices and possesses none of the aforementioned disadvantages. To attain this, the present invention contemplates a high-field permanent magnet which maintains a substantially constant magnetic field under temperature changes.

More specifically, the present invention is directed to a permanent magnet comprised of a first shell of magnetic material having a hollow cavity. The first shell has a remanence to produce a first uniform field in the cavity. The first shell has a temperature coefficient such that the first uniform field varies in magnitude with temperature. A second shell of magnetic material is mounted concentrically with the first shell and has a remanence substantially the same as the remanence of the first shell. The second shell is magnetized to produce a second uniform field in the cavity in the same direction as the first uniform field. The second shell has a temperature coefficient that is opposite to and much larger in magnitude than the temperature coefficient of the first shell. Changes in temperature will cause the first and second uniform fields to vary oppositely in magnitude by substantially the same amount. As such, there will be no net change in the resultant cavity field.

The exact nature of this invention, as well as other objects and advantages thereof, will be readily apparent from consideration of the following specification relating to the annexed drawing.

DETAILED DESCRIPTION OF THE PREFERRED EMBODIMENTS

Figure 1:
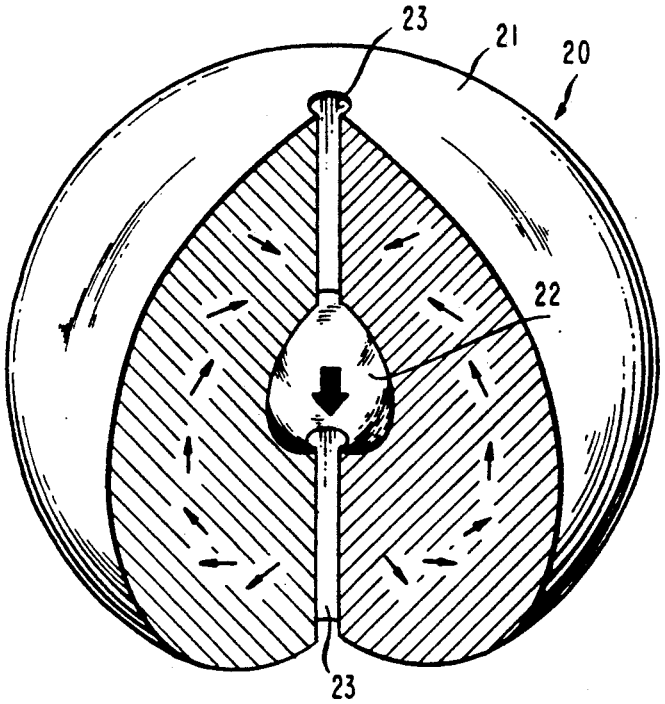
FIG. 1 (PRIOR ART)
FIG. 1 is a pictoral view in cross section of an idealized prior art device.

Referring now to the drawings there is shown in FIG. 1 a high-field permanent magnet 20 having a spherical shell 21 and a spherical cavity 22. The FIG. 1 illustration depicts the magnet 20 in pictoral form with a ninety-degree portion of the spherical shell 21 cut away to reveal the cross-sectional shapes of shell 21 and the inner cavity 22. A small, circular bore 23 is shown extending axially through the poles of the spherical shell 21 and the cavity 22. The bore 23 is of a sufficient size to obtain access to the cavity 22.

A magic sphere similar to the magnet 20 is described in detail in U.S. Pat. No. 4,837,542. Briefly, the shell 21 is composed of magnetic material that is permanently magnetized in a direction that varies continuously with and twice as fast as the polar angle, wherein the longitudinal axis of bore 23 defines the polar axis and the spherical center of shell 21 defines the pole. The thin arrows in FIG. 1 depict the magnetization of the material of shell 21 at the locations indicated. The thick arrow in the cavity 22 illustrates a uniform high field that will constitute the substantial portion of the working field produced by the magnetic material of shell 21. There will be an additional exterior field in the bore 23. It is these fields in bore 23 and cavity 22 that normally constitute the working field of the magnet 20. The magnitude of the working field is often greater than the remanence of the magnetic material of shell 21.

It is noted that the bore 23 accommodates a utilization means (not shown) which interacts with the working fields. Such utilization means may be one or more electrical wires, a waveguide, or a beam of charged particles (e.g., electrons, protons, etc.). Other types of access openings that may be provided include a lateral bore and a disc-shaped gap for accommodating a disc-shaped conductive rotor.

Figure 2:
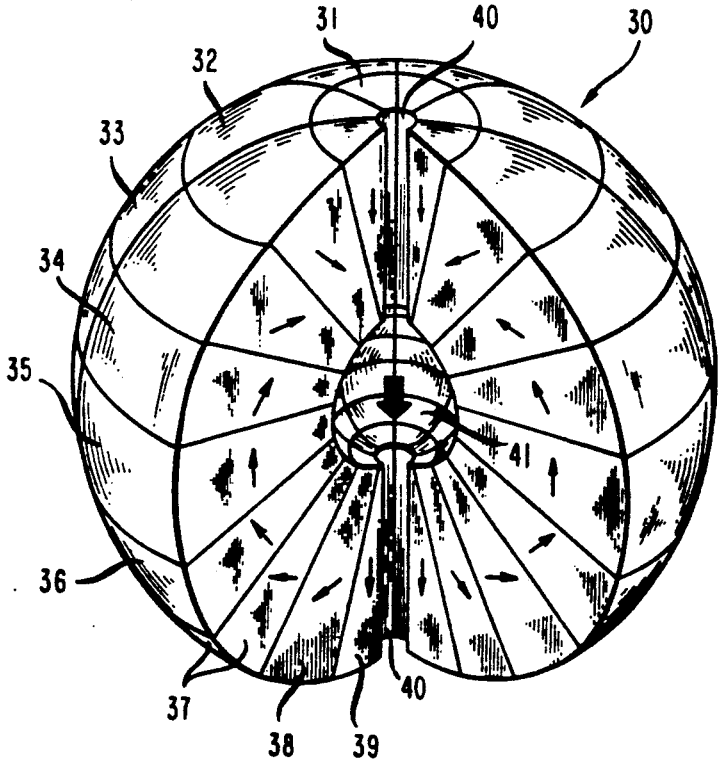
FIG. 2 (PRIOR ART)
FIG. 2 is a break-away pictoral view of another prior art embodiment.

FIG. 2 illustrates a compact magic-sphere type magnet 30 that is easier to fabricate than the ideal magic sphere of FIG. 1. In the ideal case (FIG. 1), the magnetization is substantially constant in magnitude but continuously varies in direction as a function of the polar angle. In the FIG. 2 embodiment, the magnet 30 is fabricated from a plurality of nested segments, each of which has a magnetization that is constant in both magnitude and direction throughout each segment. The FIG. 2 embodiment is more practical to fabricate than the FIG. 1 embodiment because it is easier to fabricate a number of segments with each having a constant magnetization than to fabricate an entire spherical magnet whose magnetization varies continuously throughout.

The magnet 30 is comprised of a series of cones 31–39. Disregarding the access bore 40 for the time being, the polar cones 31, 39 are solid and the series of nested cones 32–38 have the appearance of conical shells. Considering cone 32, by way of example, it is readily seen to be a conical shell having outer surfaces that are conical. While nine cones have been depicted in FIG. 2, the magnet 30 might comprise a fewer or larger number of nested cones to form a hollow sphere with a spherical cavity 41. Of course, the larger the number of cones, the closer the magnet 30 will approximate the ideal magnet 20 (FIG. 1). It is noted that the magnet 30 is composed of seventy-two segments and that a 90-degree portion composed of eighteen segments is broken away and not shown in FIG. 2.

More specifically, each of the cones 31–39 is segmented along distinct lines of longitudinal meridians. It will be evident from FIG. 2 that the cones 31 and 32, for example, are each comprised of eight similar segments (two segments of cones 31, 32 are not shown due to the partial break-away). While the cones 31–39 are illustrated as being segmented into eight segments, they may comprise a fewer or greater number of segments; the greater the number of segments, the closer the approximation to the ideal case (FIG. 1). The magnetization in each of the segments of cones 31–39 is constant throughout in both magnitude and direction. However, the magnetization from segment to segment varies with the average polar angle of the segment so as to closely approximate the ideal case (FIG. 1). It has been found that even with as few as eight segments as shown in FIG. 2, more than 90 percent of the field of the ideal structure is obtainable.

If a field of 20 kilo-oersteds (kOe) is desired in the central cavity 41 having a diameter of 1.0 centimeter (cm), and if the magnetic material of cones 31–39 has a remanence of 12 kG, the outer diameter of magnet 30 need be only 3.49 cm. The structure would weigh about 0.145 kilogram (kg), an extraordinarily small mass for so great a field in that volume.

Figure 3:
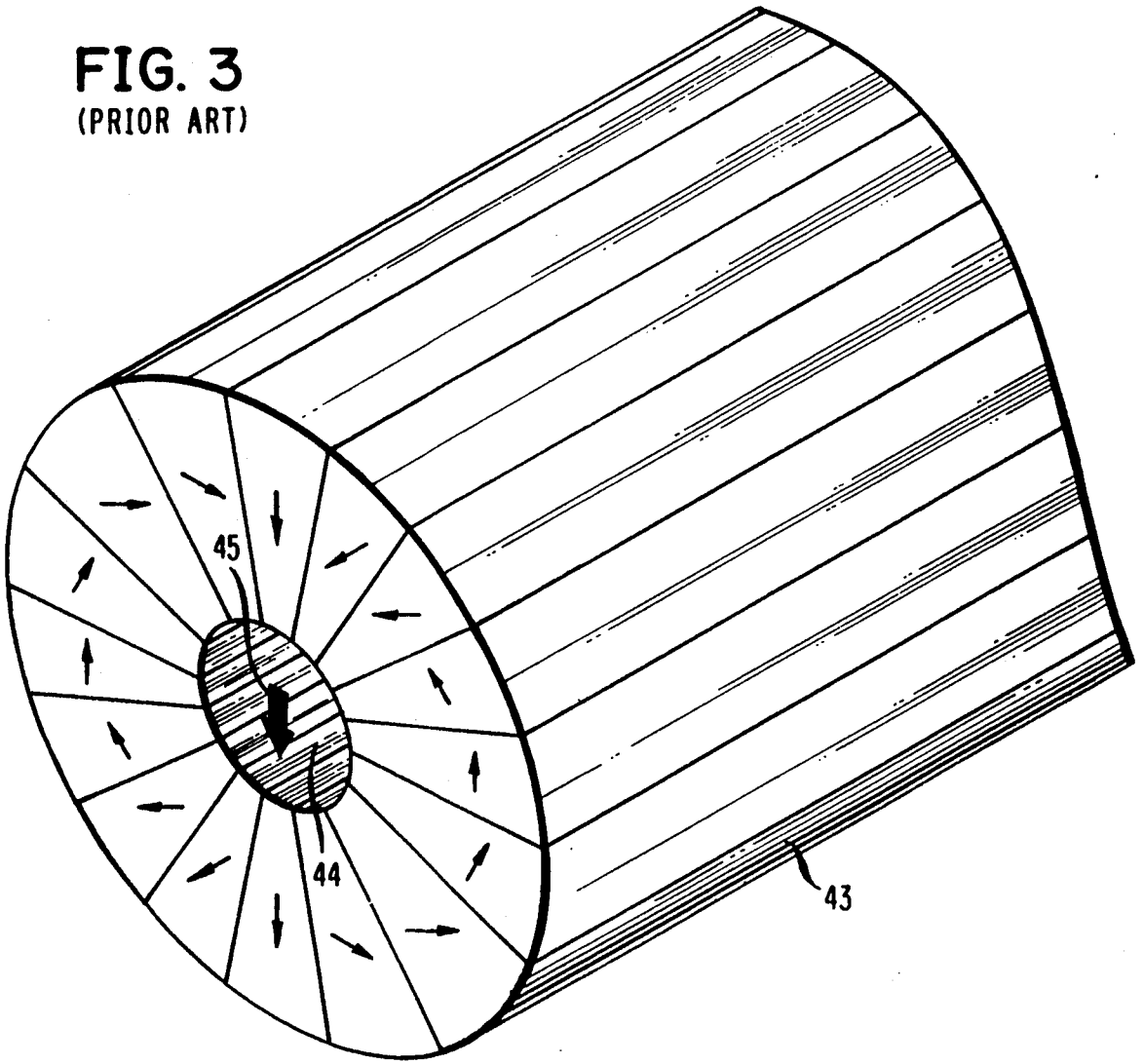
FIG. 3 (PRIOR ART)
FIG. 3 is a pictoral view of still another prior art embodiment.

FIG. 3 illustrates a prior art magic ring 43 having a plurality of segments that are nested to form a cylindrical magnet having a hollow cavity 44. The segments are similarly shaped. Also, each segment is uniformly magnetized in a plane perpendicular to the cylindrical axis of magic ring 43 and in a direction that varies with and twice as fast as the polar angle where the cylindrical axis is the pole. The thick arrow 45 in the cavity 44 represents a uniform high field that will constitute the substantial portion of the working field produced by the magnetic material of the magic ring 43. Access to the cavity 44 may be reached via the open ends of the cavity 44.

Figure 4:
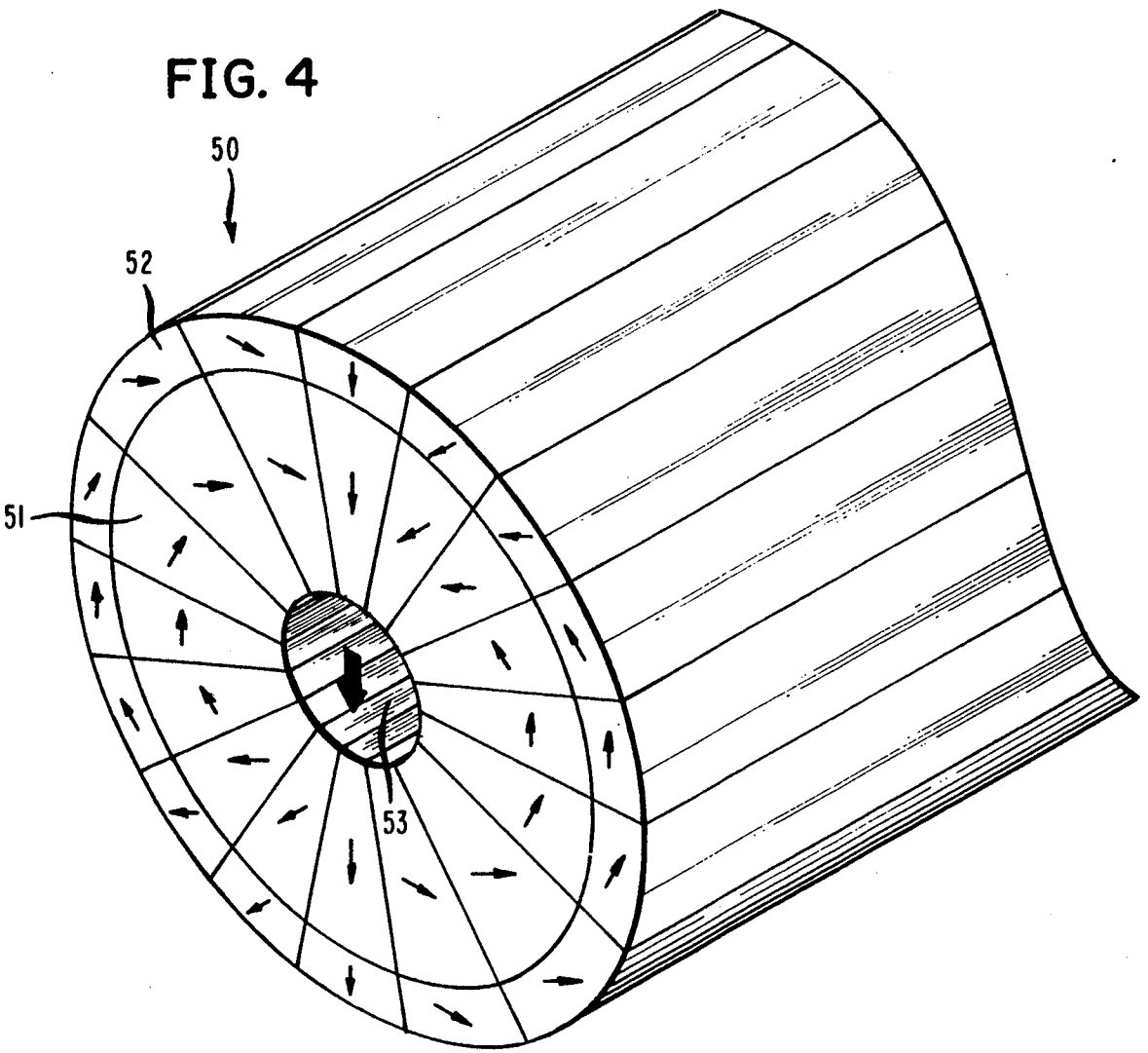
FIG. 4 is a pictoral view of a preferred embodiment.

FIG. 4 illustrates how a temperature compensation means is provided to maintain the working field at a constant value with a high degree of precision in an iron-free magnet structure, i.e. a yokeless magnet. The invention contemplates a permanent magnet of high symmetry, e.g. magic spheres, toroids, igloos, rings, etc. FIG. 4 illustrates a magic-ring type magnet 50. In essence, magnet 50 comprises coaxial inner and outer magic rings 51, 52. Magic ring 51 is made up of a plurality (sixteen are shown for illustration purposes only) segments that are nested to form a cylindrical magnet having a cylindrical hollow cavity 53. Each segment is uniformly magnetized in a plane perpendicular to the cylindrical axis of magnet 51 and in a direction that varies with and twice as fast as the polar angle where the cylindrical axis is the pole.

The outer magic ring 52 is segmented in a similar fashion to that of magic ring 51. Additionally, corresponding segments of the rings 51 and 52 are magnetized in the same direction. As such, the magnitudes of the working field (thick arrow) produced in cavity 53 will be the sum of the fields produced by the inner and outer magic rings 51, 52.

The magic ring 51, when constructed of conventional high-remanence materials, will usually be slightly sensitive to temperature. Such materials are said to have either a negative or positive temperature coefficient depending on whether the remanence and temperature changes are the same or opposite in magnitude Compensation for variations in the working field of cavity 53 due to temperature changes in the present invention is accomplished by adding the ring 52 which encases the inner magic ring 51. It is contemplated that the inner ring 51 be made of the desired high-remanence material to produce the working field in cavity 53. Outer ring 52 is constructed of a material having a remanence close to that of the material used in ring 51 but having a temperature coefficient that is opposite in magnitude that of the material of ring 51. If the opposing temperature coefficient of outer ring 52 is greater in magnitude than ring 51, then outer ring 52 may be made much thinner than that of ring 51 and temperature compensation will be achieved without significant debasement of the remanence of ring 51. As such, there will be little or no significant loss in the working field by, in effect, replacing a small amount of the inner ring 51 with the outer ring 52. Alternatively, the outer ring 52 could be the predominant magnet with a thin inner ring added for temperature compensation.

Figure 5:
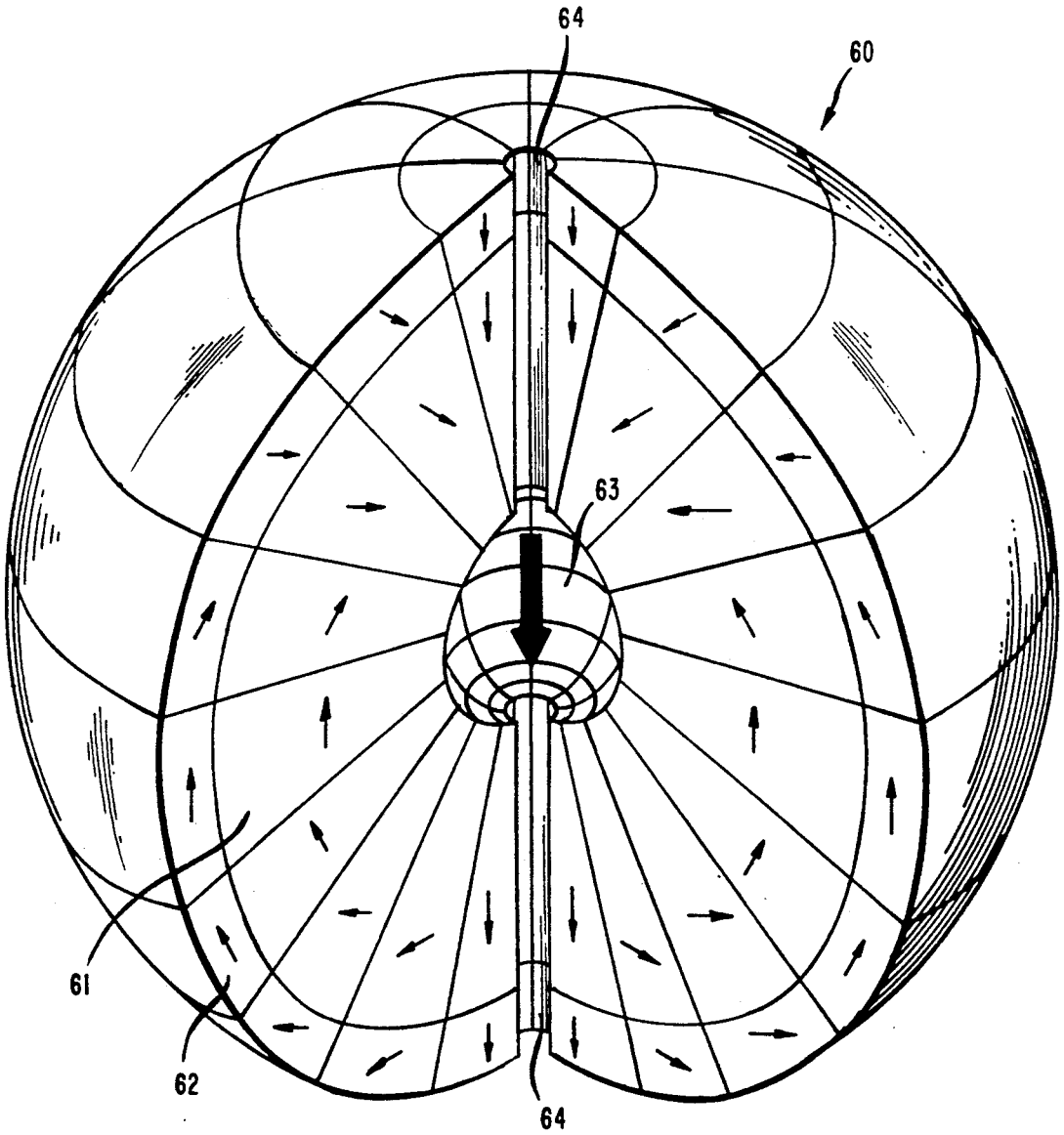
FIG. 5 is a break-away pictoral view of an alternate embodiment.

FIG. 5 illustrates a temperature-compensated magic-sphere type magnet 60 constructed in a similar fashion to that of the magnet 50 (FIG. 4). Magnet 60 comprises concentric inner and outer magic spheres 61, 62 with a central cavity 63 and an access bore 64. The outer magic sphere 62 encases sphere 61 and is segmented in a fashion similar to that of sphere 61. Additionally, corresponding segments of the spheres 61 and 62 are magnetized in the same direction. As such, the magnitudes of the working field (thick arrow) produced in cavity 63 will be the sum of the fields produced by the inner and outer magic spheres 61, 62.

As with the magnet 50, the inner sphere 61 is made of a desirable high-remanence material to produce the working field in cavity 63. Outer sphere 62 is constructed of a material having a remanence close to that of the material used in sphere 61 but with a temperature coefficient that is opposite in magnitude to that of the material of sphere 61. If the opposing temperature coefficient of outer ring 52 is greater in magnitude than ring 51, then outer sphere 62 may be 5 made much thinner than that of sphere 61 and temperature compensation will be achieved without debasement of the remanence of the sphere 61.

Of course, in the light of the above teachings, similar applications of the present invention to magic toroids, igloos, etc. will be obvious to those skilled in these arts. It should be understood, therefore, that the foregoing disclosure relates to only preferred embodiments of the invention and that numerous other modifications or alterations may be made therein without departing from the spirit and the scope of the invention as set forth in the appended claims.

What is claimed is:

1. A permanent magnet comprising:

a first shell of magnetic material having a hollow cavity, said first shell being magnetized and having a remanence to produce a first uniform field in said cavity and said first shell having a temperature coefficient such that said first uniform field varies in magnitude with temperature; and a second shell mounted concentrically with said first shell, said second shell haivng a remanence substantially the same as the remanence of said first shell and being magnetized to produce a second uniform field in said cavity in the same direction as said first uniform field, said second shell having a temperature coefficient that is opposite in magnitude to the temperature coefficient of said first shell.

2. The magnet of claim 1 wherein said first shell and said second shell are coaxial magic rings.

3. The magnet of claim 2 wherein said second shell is mounted exterior of said first shell.

4. The magnet of claim 2 wherein said shells are formed from uniformly magnetized segments.

5. The magnet of claim 1 wherein said shells are concentric magic spheres.

6. The magnet of claim 5 wherein said second shell encases said first shell.

7. The magnet of claim 5 wherein said shells are formed from uniformly magnetized segments.

* * * * *